United States Patent [19]

Karino

[11] 4,119,684

[45] Oct. 10, 1978

[54] VARIABLE STAGE TYPE CARBURETOR

[75] Inventor: Kimiji Karino, Katsuta, Japan

[73] Assignee: Hitachi, Ltd., Japan

[21] Appl. No.: 839,256

[22] Filed: Oct. 4, 1977

[30] Foreign Application Priority Data

Oct. 6, 1976 [JP] Japan ..... 51-119365

[51] Int. Cl.[2] ..... F02M 9/08

[52] U.S. Cl. ..... 261/44 F; 261/52; 261/DIG. 56

[58] Field of Search ..... 261/44 F, 52, DIG. 56

[56] References Cited

U.S. PATENT DOCUMENTS

| | | | |
|---|---|---|---|
| 3,896,195 | 7/1975 | Harrison | 261/44 F |
| 3,937,768 | 2/1976 | Bier et al. | 261/44 F |
| 3,956,434 | 5/1976 | Dickensheets et al. | 261/44 F |
| 4,005,161 | 1/1977 | Shimo et al. | 261/52 |

*Primary Examiner*—Tim R. Miles

*Attorney, Agent, or Firm*—Craig & Antonelli

[57] ABSTRACT

A variable stage type carburetor has a vane controller adapted to forcibly bias a vane to a smaller opening degree when a throttle valve has been opened nearly to the maximum opening degree and, accordingly, the venturi vacuum is small. Between a limiting lever connected to a diaphragm of the vane controller and an interlocking lever connected to the vane, provided is an interlocking spring for affording a relative movement between the vane and the throttle valve. The interlocking spring can be deflected with a reduced force when the throttle valve has been opened nearly to the maximum opening degree.

1 Claim, 7 Drawing Figures

VARIABLE STAGE TYPE CARBURETOR

LIST OF PRIOR ART REFERENCE (37 CFR 1.56 (a))

The following reference is cited to show the state of the art:

U.S. Pat. No. 4,005,161, Shoji Shimo et al., filed Feb. 18, 1975, issued Jan. 25, 1977, 261/44R: 261/52.

BACKGROUND OF THE INVENTION

The present invention relates to a variable stage type carburetor and, more particularly, to a carburetor of the type provided with a vane controller for controlling the venturi pressure in the heavy load low speed operating phase of engine.

Variable stage carburetors have been publicly known. The carburetor of this type is provided in its intake passage with a throttle valve and a vane interlocked with the throttle valve and constituting a variable venturi portion. Further, means are provided in a fuel passage which opens in the variable venturi portion for varying the fuel metering area in response to the operation of the vane.

The variable stage type carburetor has an advantage, owing to the provision of the vane interlocked with the throttle valve and constituting the variable venturi portion, that a large vacuum can be obtained at the venturi portion, resulting in a good atomization of the fuel.

However, on the other hand, the variable stage carburetor has suffered from a problem that the vacuum established at the venturi portion inconveniently gets low, i.e. gets closer to the atmospheric pressure, during heavy load low speed operation of engine in which the throttle valve is fully opened, due to the interlocking of the vane with the throttle valve, so as to make the rate of the fuel supply undesirably small. This results in a reduced output power of the engine and, in the worst case, stalling of the engine.

In order to avoid this problem, the specification of U.S. Pat. No. 4,005,161 suggests to provide a vane controller which is adapted to preserve the opening degree of the throttle valve, while displacing the vane slightly to smaller opening degree, when the vacuum at the venturi is lowered in the full-throttle-opening operation.

The aforementioned problem in the heavy load low speed operation of engine is effectively overcome by the provision of the vane controller. However, since this vane controller functions to displace the vane to smaller opening degree while preserving the opening degree of the throttle valve, when the throttle valve is opened to the largest opening degree or therearound, the mechanical connection has to include a resilient means such as a torsion spring, for allowing the relative movement between the vane and the throttle valve. Due to the provision of the resilient means, the vane controller requires an unacceptably large actuating power.

BRIEF SUMMARY OF THE INVENTION

It is therefore an object of the invention to provide a variable stage type carburetor having a vane controller, in which the deflection of the resilient means acting between the vane and the throttle valve is gradually decreased as the opening degree of the throttle valve is increased, so that the resilient means may be deflected with a reduced force when the throttle valve is around its fully opened position, thereby to ensure the operation of the vane controller with reduced actuating force, as well as a constant air-fuel ratio characteristic, minimizing the size of the vane controller.

The above and other objects, as well as advantageous features of the invention will become clear from the following description of the preferred embodiment taken in conjunction with the attached drawings.

DETAILED DESCRIPTION OF THE PREFERRED EMBODIMENT

Figure 1:
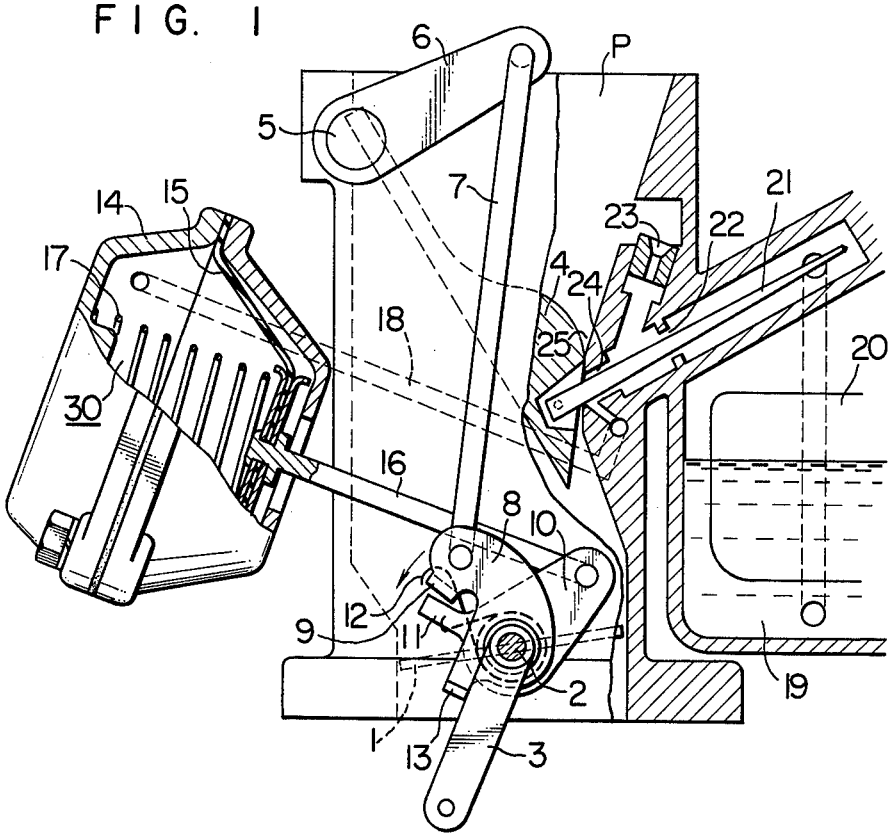
FIG. 1 is a side view of variable stage type carburetor embodying the present invention.

Referring at first to FIG. 1 showing a variable stage carburetor in accordance with the invention, a throttle valve 1 carried by a throttle valve shaft 2 is disposed in an intake passage which passes vertically through the carburetor barrel. To the throttle valve shaft 2, connected is a throttle lever 3 which in turn is operably connected to an accelerator pedal (not shown) through a wire and other associated members.

A vane 4 is supported by a vane shaft 5 and is located upstream from the throttle valve 1. A vane lever 6 is fixed to the vane shaft 5 at its one end. The vane shaft is connected at its other end, through an interlocking rod 7, to an interlocking lever 8 which is loosely fitted into the throttle valve shaft 2. The interlocking lever 8 has a bent portion 13 in the form of a claw and another bent portion 9. A limiting lever 10 loosely fitted to the throttle valve shaft 2 has a projection 11 which is located to oppose to the bent portion 9.

The limiting lever 10 is connected, through a rod 16, to a diaphragm 15 of a vane controller 14. The diaphragm 15 is normally biased rightward to the illustrated position, by a control spring 17. A vacuum chamber 30 defined at one side of the diaphragm 15 is communicated with a venturi portion 25 of the carburetor through a vacuum passage, so that the vacuum at the venturi portion 25 may be applied to the diaphragm 15.

The bottom of a float chamber 19 is in communication with an orifice 22 through a fuel passage 20. A needle jet 21 secured to the end of the vane 4 is made to pass through the orifice 22. The orifice 22 and the needle jet 21 thus constitute, in combination with each other, a fuel metering portion.

A bleed port 23 is provided for supplying bleed air to the downstream side of the orifice 22, while a nozzle 24 is provided to open in the venturi portion 25.

In the carburetor having above stated construction, the present invention is characterized by a provision of an interlocking spring 12 between the bent portion or claw 9 of the interlocking lever 8 and the projection 11 of the limiting lever 10, as will be seen from FIGS. 1 to 4.

Turning again to FIG. 1 showing the carburetor in the stopped state of the engine, the vacuum chamber 30 of the vane controller is subjected to atmospheric pressure, so that the limiting lever 10 is biased to the illustrated position by the control spring 17, through the rod 16.

In this state, the interlocking spring 12 exerts a small force to rotate the interlocking lever 8 counterclockwise, so that the claw 13 is in contact with a side of the throttle lever 3, as illustrated.

As the engine is started, the vacuum established at the venturi portion 25 is transmitted to the vacuum chamber 30 of the vane controller 14, so that the diaphragm 15 is deflected leftward, compressing the control spring 17, thereby to rotate the limiting lever 10 counterclockwise, through the rod 16. This operation is well illustrated in FIG. 2.

As a result of the displacement of the limiting lever 10, the interlocking spring 12 is twisted to exert a counterclockwise rotational biasing force on the interlocking lever 8. However, in this state, the interlocking lever 8 and the interlocked vane 4 are kept unmoved to preserve the posture of FIG. 1, because the claw 13 abuts the side of the throttle lever 3.

As the throttle lever 3 is rotated for a larger opening degree of the throttle valve 1, the interlocking lever 8 is rotated counterclockwise, due to the force exerted by the spring 12, with the claw 13 keeping the contact with the side of the throttle lever 3.

Figure 3:
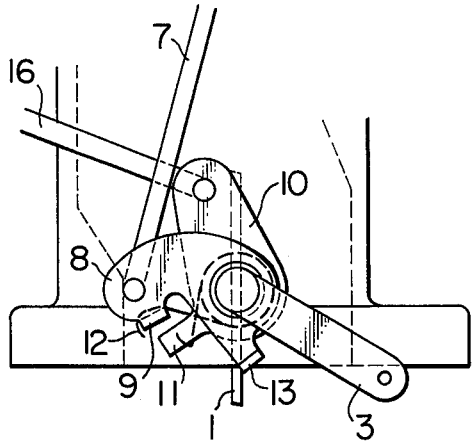
FIG. 3 is a partial illustration of the carburetor in the full-throttle-opening state.

Thus, the interlocking lever 8 follows the movement of the throttle lever 3, up to the $\frac{2}{3}$ of full-opening of the throttle valve, but preserves a constant position for a further opening of the throttle valve 1. In this state, the vane 4 has been fully opened, and the counterclockwise rotational force exerted by the spring 12 on the lever 8 is received by a stopper (not shown) which comes into contact with the interlocking lever 8 or vane 4 when the vane 4 is fully opened. FIG. 3 shows the state in which the throttle valve 1 has been fully opened.

As the throttle valve has been opened nearly to the maximum opening degree, the vacuum at the venturi portion 25 and, accordingly, at the vacuum chamber 30 of the vane controller 14 is lowered to allow the controlling spring 17 to displace the diaphragm 15 rightward, so that the limiting lever 10 is rotated clockwise through the rod 16.

Figure 4:
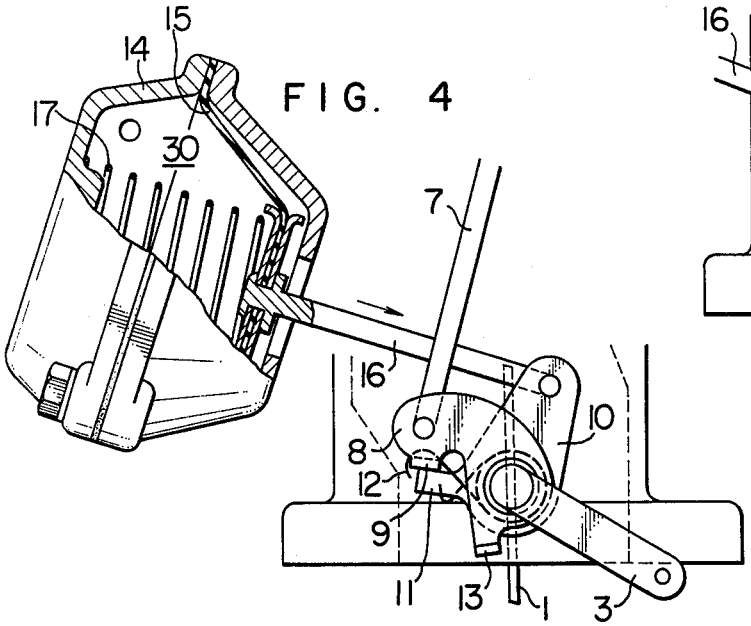
FIG. 4 is a partial illustration of the carburetor showing the operation of a vane controller in the full-throttle-opening state.

Consequently, the claw 11 of the lever 10 comes into engagement with the claw 9 of the interlocking lever 8, so as to rotate the latter clockwise to displace the vane 4 in the closing direction, as shown in FIG. 4.

Figure 5:
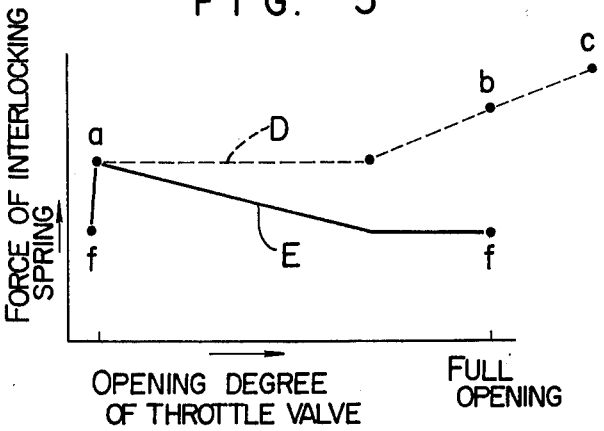
FIG. 5 is a graphical representation of the relationship between the opening degree of the throttle valve and the force exerted on a spring acting between the vane and the throttle valve.
Figure 6:
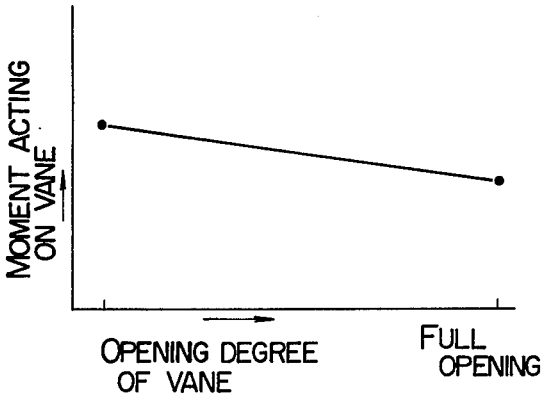
FIG. 6 is a graphical representation of the opening degree of the vane and the moment acting on the vane.

A full line curve E in FIG. 5 shows the change of the interlocking spring 12, in the course of above stated operation, in relation to the varying opening degree of the throttle valve 1. More specifically, the force of the interlocking spring 12 is designated at *f*, before the starting of the engine. This corresponds to the state of FIG. 1 in which the claw 9 is in the vicinity of the projection 11.

Figure 2:
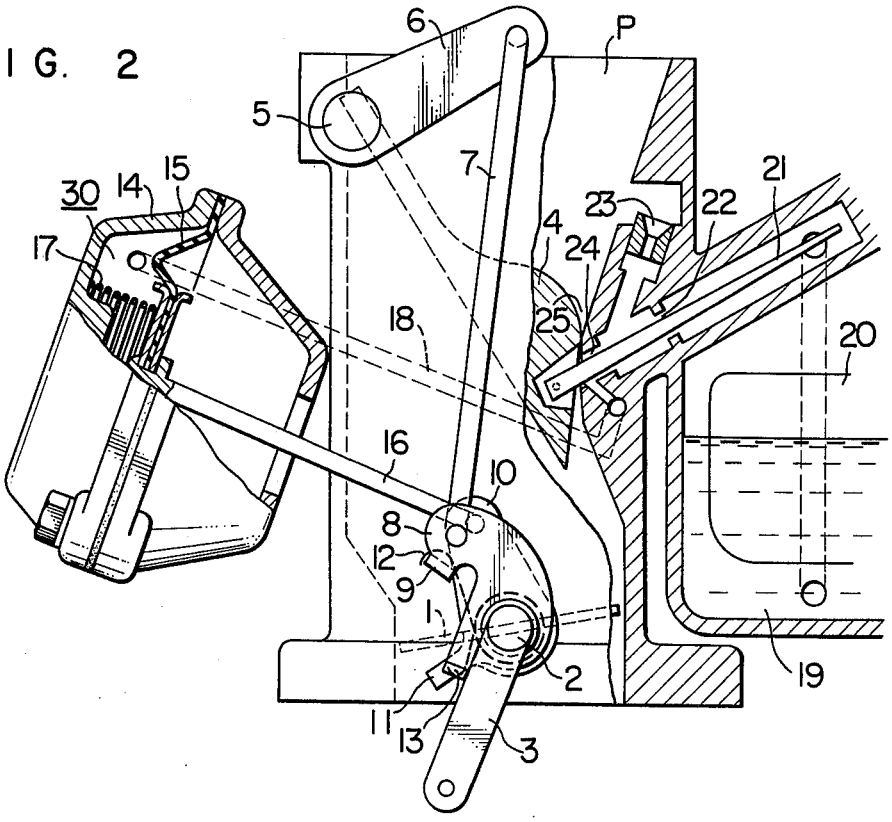
FIG. 2 is a side view of the carburetor in idling position.

As the engine is started, the interlocking spring 12 is twisted to the maximum degree, as shown in FIG. 2, to exert an increased force *a*. The interlocking mechanism is so adjusted that the level of the force a well corresponds to that of the force of the interlocking spring in the conventional carburetor. In accordance with the increase of the opening degree of the throttle valve, the spring force is gradually decreased, because the claw 9 and the projection 11 gradually approach each other, and falls to the level of *f* (the level of spring force before starting of engine.) when the throttle valve has been opened to $\frac{2}{3}$ of the maximum opening degree. The spring force is maintained at the level of *f*, for the further opening of the throttle valve.

Since the vane controller 14 functions only when the throttle valve has been opened nearly to the maximum opening degree, the controlling spring 17 of the vane controller 14 has only to have a small force which can exceed the level of force *f* and which is about a half of that of conventional arrangement designated at *c*.

It will be seen that the size of the diaphragm 15 and, accordingly, the size of the whole vane controller 14 can be made small, because of the reduced force expected on the control spring 17.

Concerning the conventional arrangement, the opening degree of the vane 4 is given by the balance or the equilibrium of the counterclockwise moment exerted by the interlocking spring 12 on the interlocking lever 8 and a clockwise moment which tends to pull the rod 16 in the direction of arrow in FIG. 4. Therefore, the interlocking moment changes following a curve D in FIG. 5, and the vacuum $P_v$ at the venturi portion is gradually decreased as shown by the broken line in FIG. 7, so that the air fuel ratio A/F gets large, i.e. the mixture gets lean, as the throttle valve is opened to the maximum opening degree, as shown by the broken line.

Figure 7:
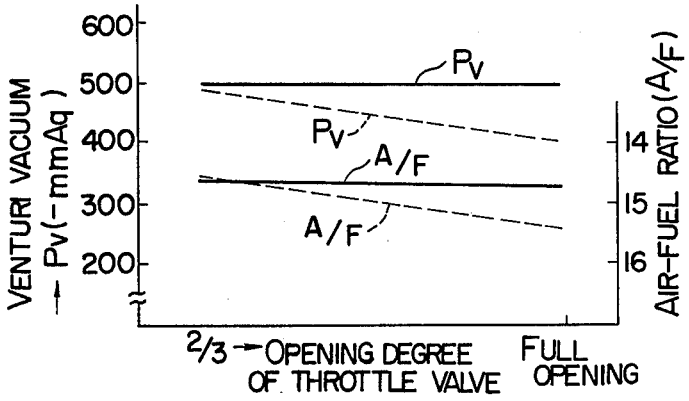
FIG. 7 is a graphical representation of the characteristic of the carburetor.

In sharp contrast to the above, the air-fuel ratio, as well as the venturi vacuum, is kept constant in the carburetor of the invention, as shown by the full-line curves in FIG. 7, thanks to the advantageous feature that the interlocking spring force is maintained constant between the $\frac{2}{3}$ and the maximum opening of the throttle valve.

What is claimed is:

1. A variable stage carburetor having a throttle valve disposed in the intake passage thereof, a vane constituting a variable venturi and disposed at the upstream side of said throttle valve, said vane being operably connected to said throttle valve, fuel metering means disposed in a fuel passage opening in said venturi and adapted to vary the cross-sectional area of said fuel passage in response to the change of opening degree of said vane, and a vane controller adapted to be actuated by the vacuum available at said venturi so as to forcibly displace said vane to a lower opening degree when said throttle valve has been opened nearly to the maximum opening degree to reduce said vacuum at said venturi, characterized by comprising an interlocking spring acting between a limiting lever connected to a diaphragm of said vane controller and an interlocking lever connected to said vane.

* * * * *